US008235686B2

(12) United States Patent
Wark

(10) Patent No.: US 8,235,686 B2
(45) Date of Patent: Aug. 7, 2012

(54) PORTABLE FAN

(76) Inventor: Cynthia A. Wark, Spring, TX (US)

( * ) Notice: Subject to any disclaimer, the term of this patent is extended or adjusted under 35 U.S.C. 154(b) by 358 days.

(21) Appl. No.: 12/466,736

(22) Filed: May 15, 2009

(65) Prior Publication Data

US 2010/0290907 A1 Nov. 18, 2010

(51) Int. Cl.
*F04B 17/00* (2006.01)

(52) U.S. Cl. ..... 417/410.1; 416/63; 416/147

(58) Field of Classification Search ..... 417/410.1; 261/28; 416/55, 62, 63, 70 A, 162, 175, 416/201 R, 205, 215
See application file for complete search history.

(56) References Cited

U.S. PATENT DOCUMENTS 6,109,874 A * 8/2000 Steiner et al. ..... 416/63
6,155,782 A * 12/2000 Hsu ..... 416/63
6,179,564 B1 * 1/2001 Park ..... 416/63
6,227,004 B1 * 5/2001 Gerstein ..... 62/421
6,409,475 B1 * 6/2002 Ho ..... 416/63
6,454,539 B1 * 9/2002 Santos ..... 417/44.1
7,089,749 B1 8/2006 Schafer
2004/0088877 A1 * 5/2004 Gilmer ..... 34/90
2005/0088866 A1 * 4/2005 Levine ..... 363/146
2008/0035662 A1 2/2008 Way
2008/0237900 A1 * 10/2008 Junkel et al. ..... 261/28

* cited by examiner

*Primary Examiner* — Anh Mai
*Assistant Examiner* — Andrew Coughlin
(74) *Attorney, Agent, or Firm* — Young Basile Hanlon & MacFarlane PC

(57) ABSTRACT

Two embodiments of a portable fan for use in the cup holder of a recreational vehicle such as a golf cart are shown and described. In the first embodiment, a bottle-shaped body has a cup-shaped lower portion separated from the body by a shoulder which acts as a limit stop when inserting the base into a cup holder. A shrouded impeller is pivotally connected to the top of the base and exhibits an integral carry handle. The entire structure is made of a suitable plastic such as high density polyethylene. In the second embodiment, the impeller is located intervally of the body for safety and a bell-shaped outlet directs air through a diffuser with circular louvers.

2 Claims, 5 Drawing Sheets

PORTABLE FAN

FIELD OF THE INVENTION

This invention relates to portable fans and more particularly to a battery operated portable fan adapted to fit into a cup holder in a recreational vehicle such as a golf cart.

BACKGROUND OF THE INVENTION

Off-road recreational vehicles including golf carts are now universally equipped with cup holders in and around the structure in front of the passengers. The term "cup holder", as used in this document, defines a slightly tapered receptacle adapted to receive a lower portion of a standard size plastic or coated paper drink cup of the type dispensed in country clubs, fast food restaurants and convenience stores. Such cup holders may have perforated bottoms for drainage and are typically made of plastic.

SUMMARY OF THE INVENTION

In general, golf is a warm weather sport and, while a breeze may be provided during movement of the cart, a good deal of the game requires the cart to he stationary. During this time, the occupants of the cart would enjoy the cooling effects of air movement produced by a portable fan.

In general, my invention is a portable fan suitable for mounting in the cup holder of a recreational vehicle, such as a golf cart, so as to provide the cooling effects of moving air when the cart is stationary. In addition, the invention enjoys easy portability, safety and rechargeability of a battery carried in the body of the fan.

In general, these benefits are achieved in a fan having a rigid base made of a material such as high density polyethylene and being of such size and shape as to accommodate a rechargeable battery therein. A portion of the base, distinguished from the base proper by means of an inwardly directed flat annular shoulder, is a cup-shaped lower portion which is integral with the base and of such size and shape as to fit conveniently and non-bindingly into the cup holder of an off-road recreational vehicle, such as a golf cart.

In a first embodiment, an impeller is pivotally attached to the upper portion of the body and has a shroud which includes an integral handle so that the fan may be easily and safely lifted from the cup holder and/or placed into the cup holder without danger of inserting ones fingers into the path of the moving impeller blades.

In a second embodiment, the impeller blades are mounted, along with a motor and battery, within the body and a bell-shaped, angled outlet is fitted to the housing to direct air to occupants of a golf cart or the like. Air intake slots are formed in the fan body and a diffuser is fitted onto the outlet to diffuse the outlet air stream and prevent foreign objects from damaging the impeller blades.

BRIEF DESCRIPTION OF THE DRAWINGS

The description herein makes reference to the accompanying drawings wherein like reference numerals refer to like parts throughout the several views, and wherein.

DETAILED DESCRIPTION OF THE ILLUSTRATIVE EMBODIMENTS

Figure 1:
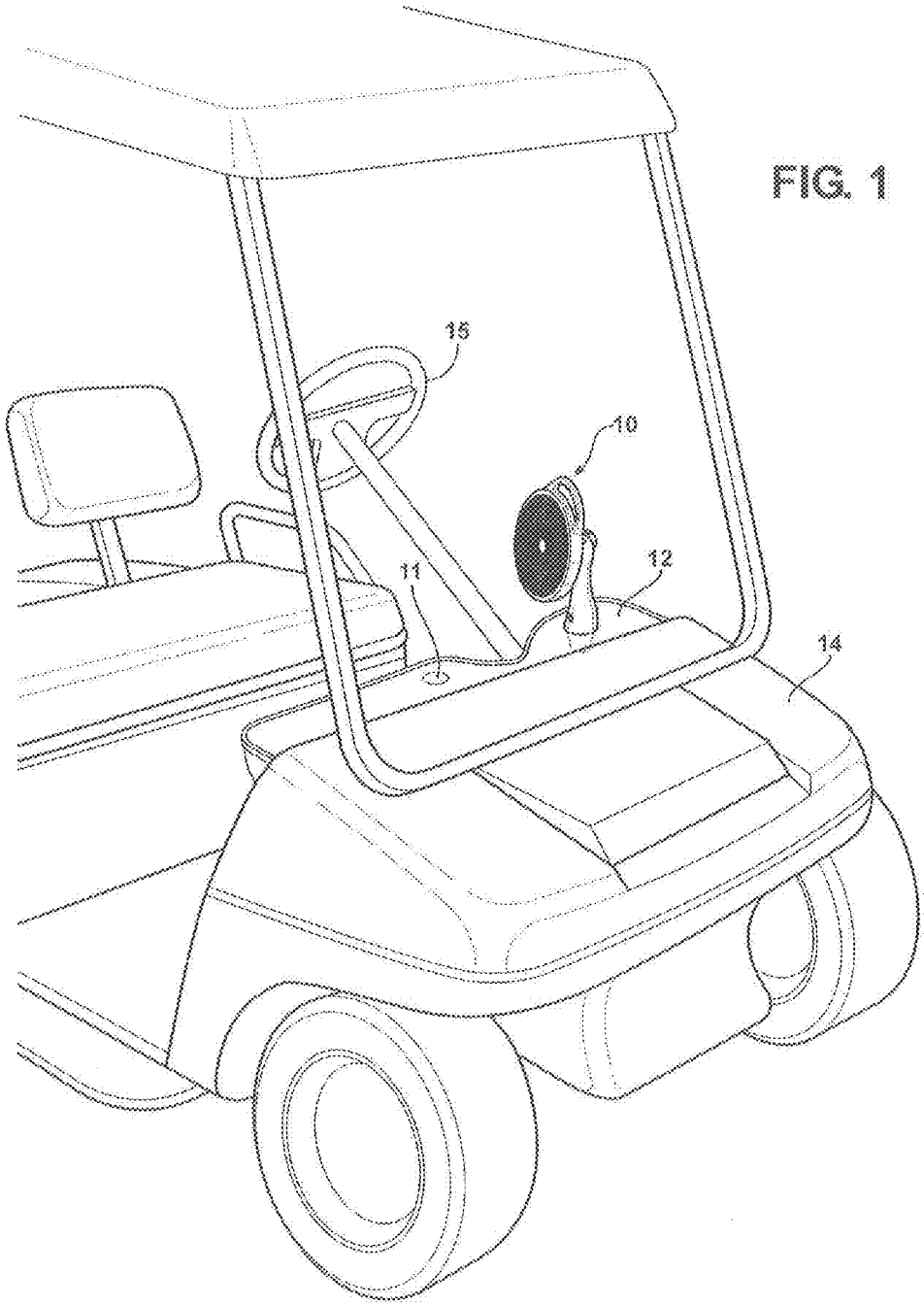
FIG. 1 is a perspective view of a golf cart equipped with cup holders, one of which carries a fan designed and fabricated according to my invention.
Figure 2:
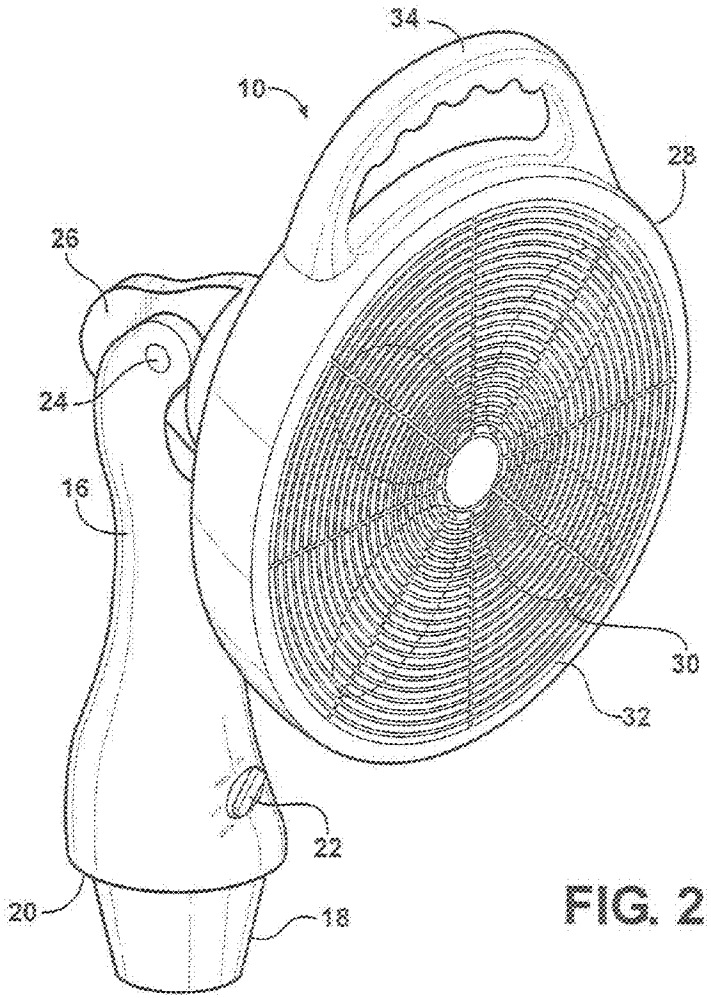
FIG. 2 is a perspective view of a fan embodying my invention along with a pair of charging cords.
Figure 2:
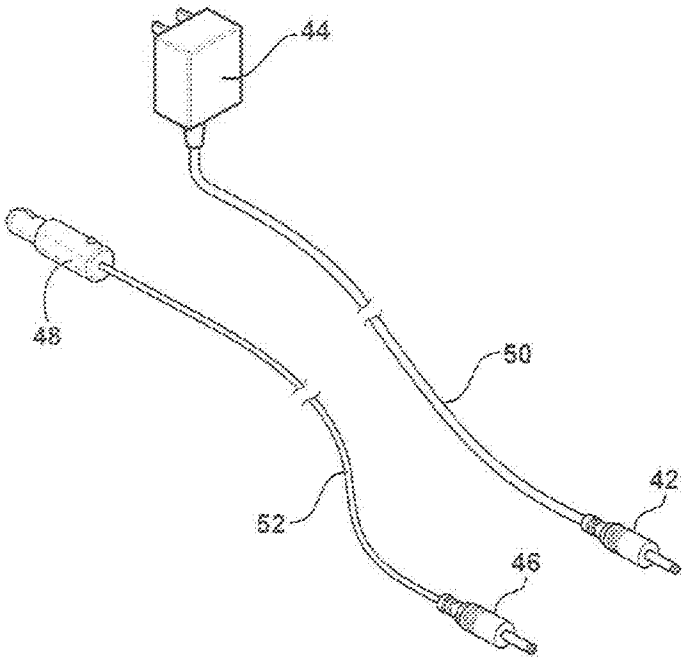
Figure 4:
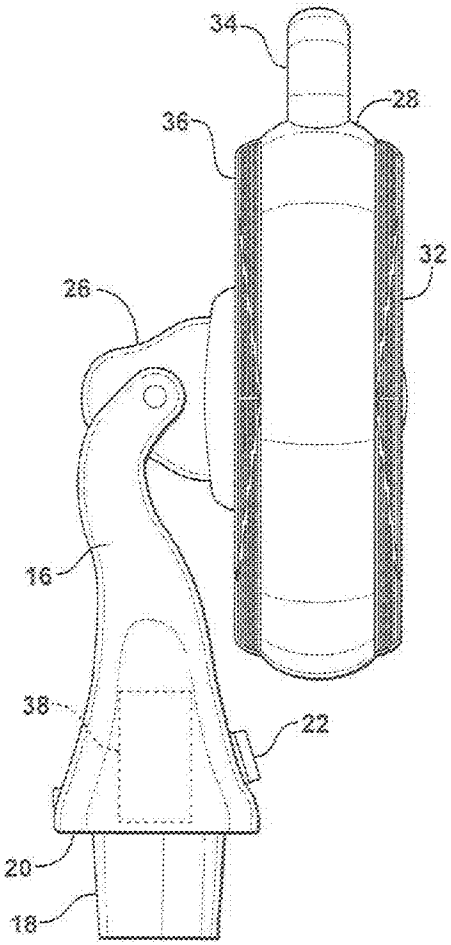
FIG. 4 is a side view of the fan of FIG. 3.
Figure 3:
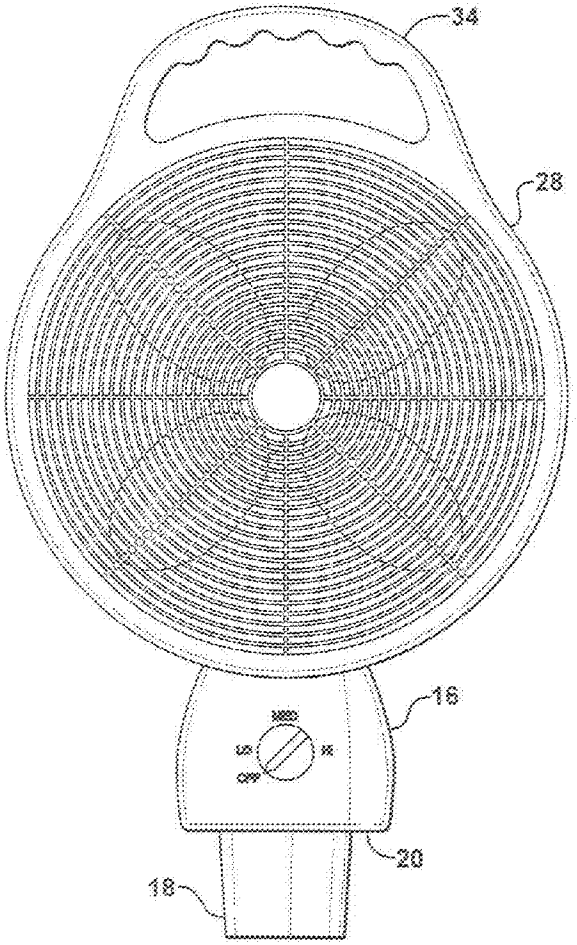
FIG. 3 is a front view of the fan according to a first embodiment of my invention.

Referring now to FIGS. 1-5 of the drawings, there is shown a portable fan 10 resting in one of two cup holders 11 in the dashboard portion 12 of a conventional golf cart 14 having a steering wheel 15. The golf cart 14 may be of any conventional type, either electric or gasoline engine powered.

The fan 10 comprises a bottle-shaped body 16 of such size and shape as to accommodate a rechargeable metal hydride battery 38 fully therein. Body 16 is made of an impact-resistant polymer such as HDPE with a smooth outer surface. The body 16 has an integral lower base portion 18 which is slightly tapered and of such size and shape as to fit into the cup holder 11 in the golf cart 14. This cup holder is of such size as to accommodate drink cups from about 8 to 20 ozs. The height of the lower base portion 18 is on the order of 2½ inches, the maximum diameter at the top of the taper is about 2½ inches, and the shoulder 20 between the lower base and the central bottle-shaped body 16 is flat and annular and serves as a mechanical stop to prevent the body from being wedged too deeply into the cup holder. The shoulder 20 also provides stability for the fan 10 while the golf cart 14 is in motion. Some golf cart cup holders have a shoulder around the receptacle which will match up with the shoulder 20.

An operating mode/speed selector 22 is mounted to the front of the body 16. Toward the top of the body 16 is a pivot 24 which accommodates a bracket 26 integrally mounted to an upper fan shroud 28 which encompasses and protects an impeller comprising a set of impeller blades 30 pivotally mounted within the shroud for rotation by a DC motor (not shown) powered by the metal hydride battery 38. The blades may he plastic or metal.

Integral with the shroud 28 is a top mounted handle 34 which allows the user to pick the fan 10 up and carry it as well as to locate the fan in a cup holder 11. The pivot allows the fan shroud to be oriented to suit the user. Screens 32, 36 on the front and back of the fan shroud protect the user from inadvertently placing his or her fingers in the path of the impeller blades 30 when they are moving.

Figures 5, 6:
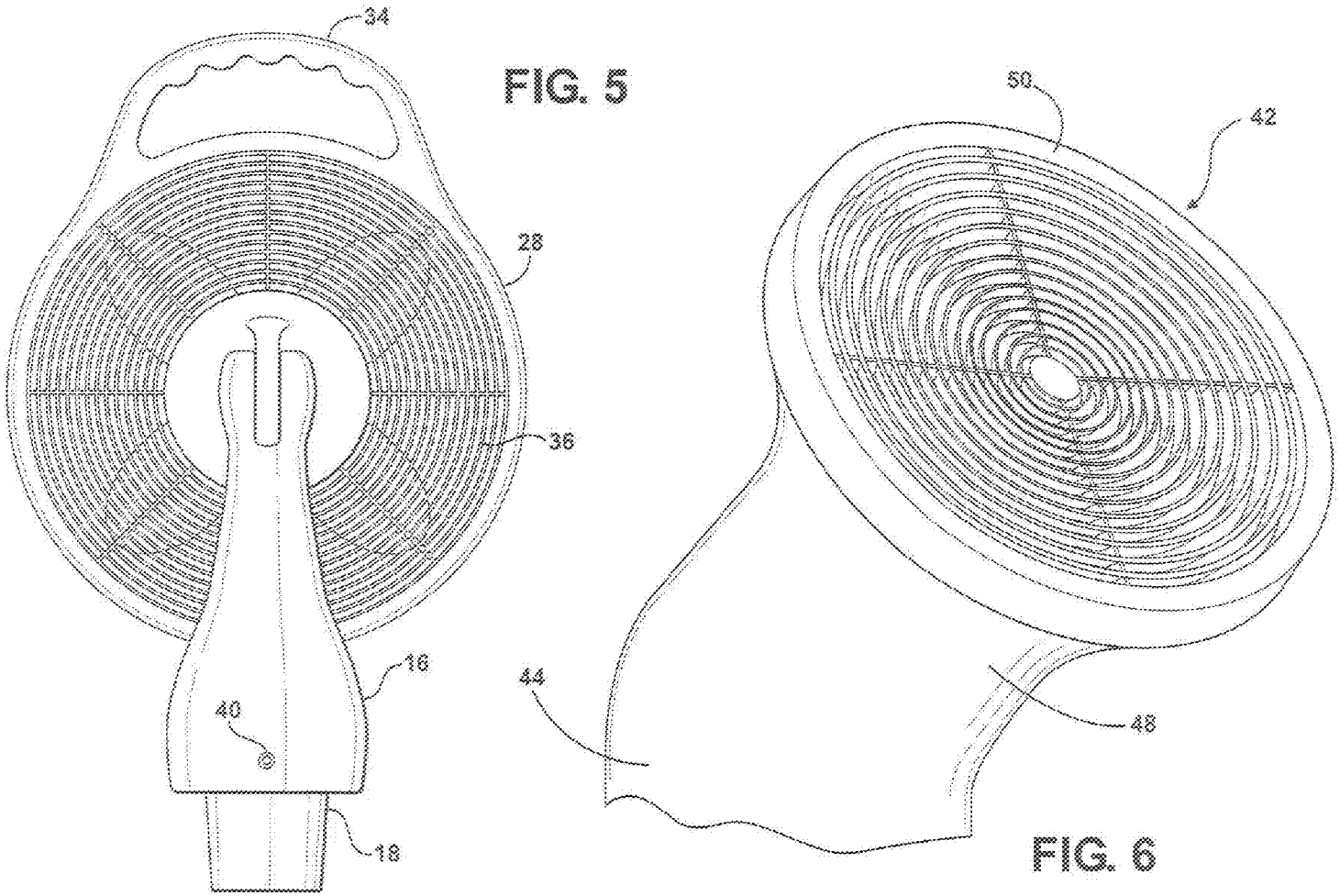
FIG. 5 is a rear view of the fan of FIG. 3.
FIG. 6 is a front view of a second embodiment of my invention.

As shown in FIG. 5 a jack 40 is provided in the back of the bottle-shaped body 16 to accommodate the plug 42 of an AC inverter/charger 44 or, alternatively, to receive the jack 46 of a DC power receptacle 48. The plugs 42, 46 are connected to cords 50, 52 respectively, in the usual fashion. The body 16 and base 18 are preferably made of durable plastic such as HDPE with a smooth outer surface. Any color may be chosen with white being preferred.

Figure 7:
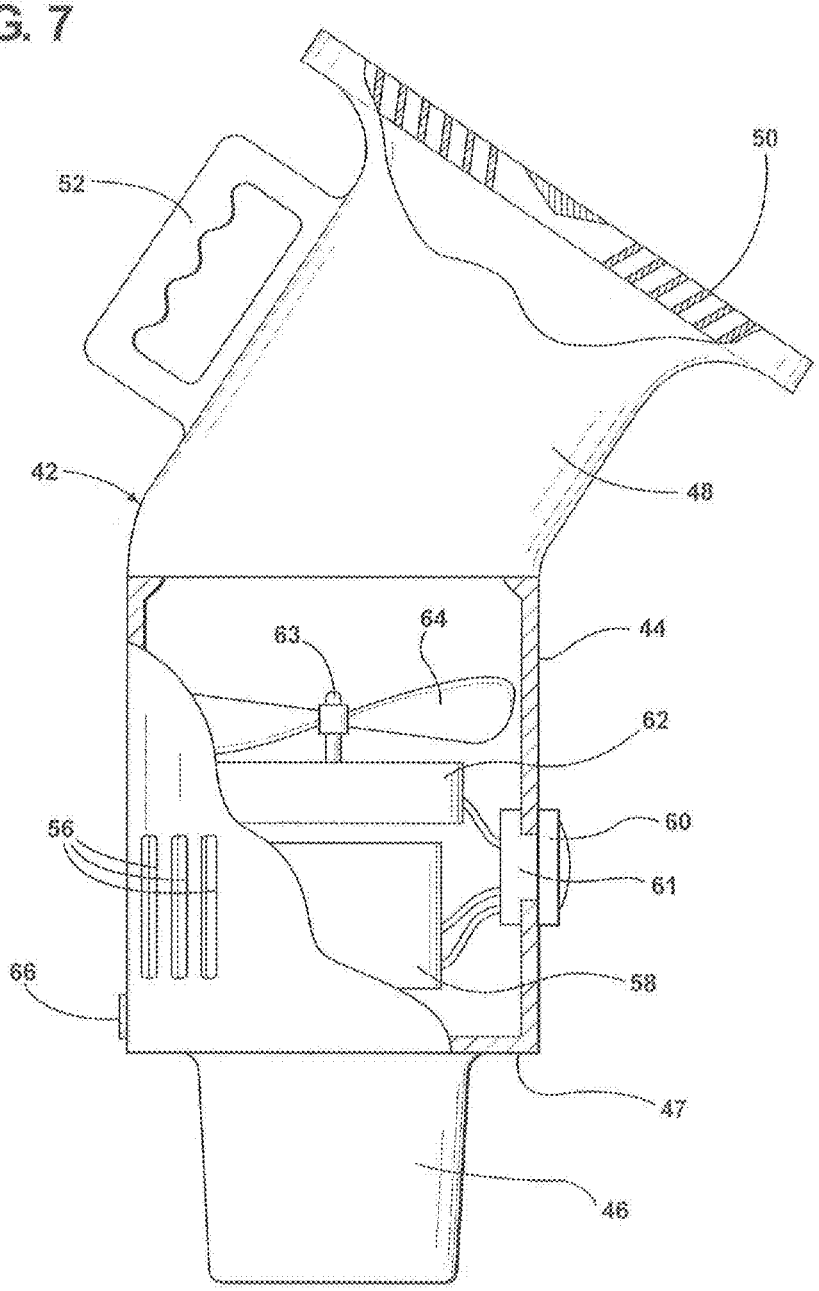
FIG. 7 is a side view, partly in section, of the embodiment of FIG. 6.

Referring now to FIGS. 6 and 7, a second embodiment of my invention is illustrated. As shown in these drawings, a portable fan 42 comprises an impact-resistant plastic body 44 having a lower cup-shaped portion 46 similar to the lower portion 18 of the first embodiment and adapted to fit within a convention cup holder of a vehicle such as a golf cart. A shoulder 47 is formed between the lower portion 46 and upper body 44 to limit the extent to which the fan 42 projects into the cup holder and to provide stability during golf cart movement.

A bell-shaped upper housing 48 provides a fan outlet which is angled relative to the axis of symmetry of the body 44. The body 48 terminates in an outwardly flaring annular portion 50 which is covered by a molded plastic diffuser 68 with circular louvers. The diffuser 48 also prevents foreign objects from entering the body. Outlet body 44 has an integral plastic carry handle 42 formed therewith. The body 48 fits on a smaller diameter extension 54 of the lower body 44.

Within the body 44 is located a metal hydride battery 58 which is adapted to power a DC "pancake" motor 62 having an output shaft 63 on which an impeller comprising fan blades 64 are mounted. Air intake slots 56 are formed around the side wall of the body 44 to provide air for the impeller which is then exhausted through the louvers of diffuser 68 toward the occupants. A speed control and on/off switch 60 is provided on the side of the housing body 44 and is connected to a circuit board 62 which, in turn, interconnects the battery 58 to the motor 62.

The entire fan 42 can be rotated in the cup holder to direct the air according to the wishes of the golf cart occupant(s).

Again, the body of the fan 42 is made of an impact-resistant plastic such as HDPE or other polymeric/elastomeric material. A charging jack 66 is provided in the body 44 and will accommodate the devices shown at 50, 52 in FIG. 2.

What is claimed is:

1. A battery-powered personal cooling fan comprising:

an elongate bottle-shaped body of molded plastic having an axis of symmetry which is vertical in use;

a battery compartment within the body;

a DC motor within the body;

a switch circuit for connecting a battery in said compartment to said motor;

an impeller mounted external to the top of the body and having blades that are substantially larger in diameter than the diameter of said body and that are rotatable about an axis of rotation which intersects said axis of symmetry at an angle;

said body having an integral tapered base of such size and shape as to fit into a conventional golf cart cup holder whereby said cooling fan may be carried by a conventional golf cart while directing air toward at least one occupant of the golf cart along an axis which is angled relative to vertical wherein the vertical dimension of the tapered base is about 2.5 inches and the diameter at the top of the tapered base is about 2.5 inches;

a shroud around said impeller and mounted to said body wherein said shroud and impeller are pivotally mounted to said body so that the angle between the axis of rotation and said axis of symmetry can be selectively varied wherein said body has an annular shoulder formed therein between the rest of said body and said integral tapered base.

2. A battery-powered personal cooling fan as defined in claim 1 wherein said shroud has a grip-type carry handle formed integrally therewith.

* * * * *